United States Patent [19]

Cottrell

[11] Patent Number: 4,569,685

[45] Date of Patent: Feb. 11, 1986

[54] MAST-TYPE ELECTRO-PRECIPITATOR DISCHARGE ELECTRODES

[75] Inventor: Terence B. F. Cottrell, Walsall, England

[73] Assignee: Lodge-Cottrell Limited, United Kingdom

[21] Appl. No.: 627,950

[22] Filed: Jul. 5, 1984

[30] Foreign Application Priority Data

Jul. 14, 1983 [GB] United Kingdom ..... 8319076

[51] Int. Cl.[4] ..... B03C 3/41

[52] U.S. Cl. ..... 55/148; 55/152; 361/230

[58] Field of Search ..... 55/148, 150–153, 55/136–138; 361/225–235

[56] References Cited

U.S. PATENT DOCUMENTS

| | | | |
|---|---|---|---|
| 2,567,709 | 9/1951 | Hedberg | 183/7 |
| 3,350,850 | 11/1967 | Steuernagel | 55/148 |
| 3,688,475 | 9/1972 | Dyla et al. | 55/148 |
| 4,115,083 | 9/1978 | Huppi | 55/148 |
| 4,321,068 | 3/1982 | Cottrell et al. | 55/148 |

FOREIGN PATENT DOCUMENTS

| | | |
|---|---|---|
| 142712 | 9/1948 | Australia . |
| 165683 | 12/1953 | Australia . |
| 167197 | 5/1954 | Australia . |
| 413828 | 12/1968 | Australia . |

*Primary Examiner*—Bernard Nozick
*Attorney, Agent, or Firm*—Daniel Rubin

[57] ABSTRACT

An electro-precipitator discharge electrode comprises connected upper and lower sections and each section comprises an elongated mast tube, a plurality of principal cross members, and a plurality of twisted discharge wires extending between the cross members and fixed therein by crimping. Upper and lower auxiliary cross members are provided to give longitudinal rigidity to the discharge electrode.

18 Claims, 5 Drawing Figures

MAST-TYPE ELECTRO-PRECIPITATOR DISCHARGE ELECTRODES

This invention relates to mast-type discharge electrodes as used in electro-precipitators particularly but not exclusively of the single stage type.

In an electro-percipitator of the single stage type charging and collection are combined. In the two stage type charging is carried out in one portion of the equipment, followed by collection in another.

Mast-type discharge electrodes are used for example in electro-precipitators of the single stage type, in rows, between rows of collector plate electrodes, the collector electrodes being earthed and the discharge electrodes being charged to a high potential e.g. 50–60 kV to deposit on the collector electrodes particulate material from gas flowing between the collector electrodes. The discharge electrodes may be for example about 15 meters in length and generally extend transversely to the direction of gas flow, and, may typically take the form of a central tube and parallel elongated discharge electrode elements, e.g. wires, spaced from the tube on horizontal cross members. During construction, typically the tube is drilled to take the cross members which are also drilled to take the wires and the whole assembly is welded together, i.e. cross members to the tube and wires to the cross members.

Not only is such a construction expensive and requires skilled labour but also difficulties arise in proper alignment of the component parts, in weakening the wires because of the welding and in distortion arising from the heat of welding.

In our U.K. patent application No. GB 2,061,772A is described means for obviating or mitigating these difficulties, particularly in regard to the fixing of the discharge electrode elements to the cross members.

The invention of U.K. patent application No. 2,061,772 provides an electro-precipitator discharge electrode comprising: (a) an elongated mast; (b) a plurality of cross members fixed to the mast, extending transversely to the mast, and having apertures extending transversely in the cross members, and (c) an elongated discharge element extending between the cross members through the apertures longitudinally of the mast and being fixed in the apertures by direct biting of the material of the cross members onto the element around the aperture.

While the invention of application No. 2,061,772 has enjoyed considerable success, problems may arise in that at times, the discharge electrode is insufficiently structurally rigid longitudinally (i.e. in directions parallel to its axis), which can lead to electrical difficulties since the spatial relationship between the collector electrodes and the discharge electrodes is critical in the electro-precipitation process and it is also important to maintain the mechanical tension in the discharge electrode elements.

This rigidity problem may arise for example when the cross members are 600 mm or more in length to accommodate several discharge elements, and again when there is a lesser number of discharge elements but they are more widely spaced.

It is an object of the present invention to provide an improved, structurally rigid mast-type discharge electrode.

We have found that a surprising degree of rigidity can be achieved by employing an auxiliary reinforcing cross member relatively closely spaced to an adjacent cross member, to provide, together with associated structure a girder structure which resists bending in the plane of the girder.

The invention provides an electro-precipitator discharge electrode comprising: (a) an elongated mast; (b) a plurality of principal cross members fixed to the mast, extending transversely of the mast, and having apertures extending transversely in the cross members; (c) an elongated discharge element extending between the cross members through the apertures longitudinally of the mast and being fixed in the apertures by direct biting of the material of the cross members onto the element; and (d) an auxiliary re-inforcing cross member also fixed to the mast extending transversely of the mast, and having the discharge element fixed thereto, the auxiliary cross member being relatively closely spaced to an adjacent principal cross member.

The discharge electrode preferably comprises another auxiliary re-inforcing cross member also fixed to the mast, extending transversely to the mast, having the discharge element fixed thereto, and being relatively closely spaced to an adjacent cross member; said plurality of principal cross members being located between the two auxiliary cross members.

The spacing of the axis of each auxiliary cross member from the axis of its adjacent principal cross member is for example from 40 mm to 65 mm.

The spacing between the axes of two auxiliary cross members is for example from 2,000 mm to 9,000 mm.

The discharge element is for example a twisted wire of square cross section in which the twisting provides from 10 to 20 turns per meter of wire.

Preferably the cross members extend at right angles to the mast symmetrically on either side of the mast and a plurality of elongated discharge elements extend between the cross members parallel to the mast.

There are for example at least two, e.g. at least three, elongated discharge elements on one side of the mast and the same on the other side.

The spacing between the axes of adjacent discharge elements on the same side of the mast is for example from 150 mm to 400 mm.

Each cross member is for example more than 600 mm in length e.g. more than 750 mm or more than 900 mm.

Preferably the principal cross members are uniformly spaced and the spacing between the axes of adjacent principal cross members does not exceed 1,600 mm and preferably does not exceed 1,500 mm.

The invention also provides an electro-precipitator comprising a plurality of collector electrodes between which are located a plurality of discharge electrodes according to the invention.

A mast-type discharge electrode embodying the present invention will now be described, by way of example, with reference to the accompanying drawing, in which.

The mast discharge electrode 10 embodying the invention comprises upper and lower sections 6,8 respectively which are connected together at a central region of the electrode 10.

Figure 2:
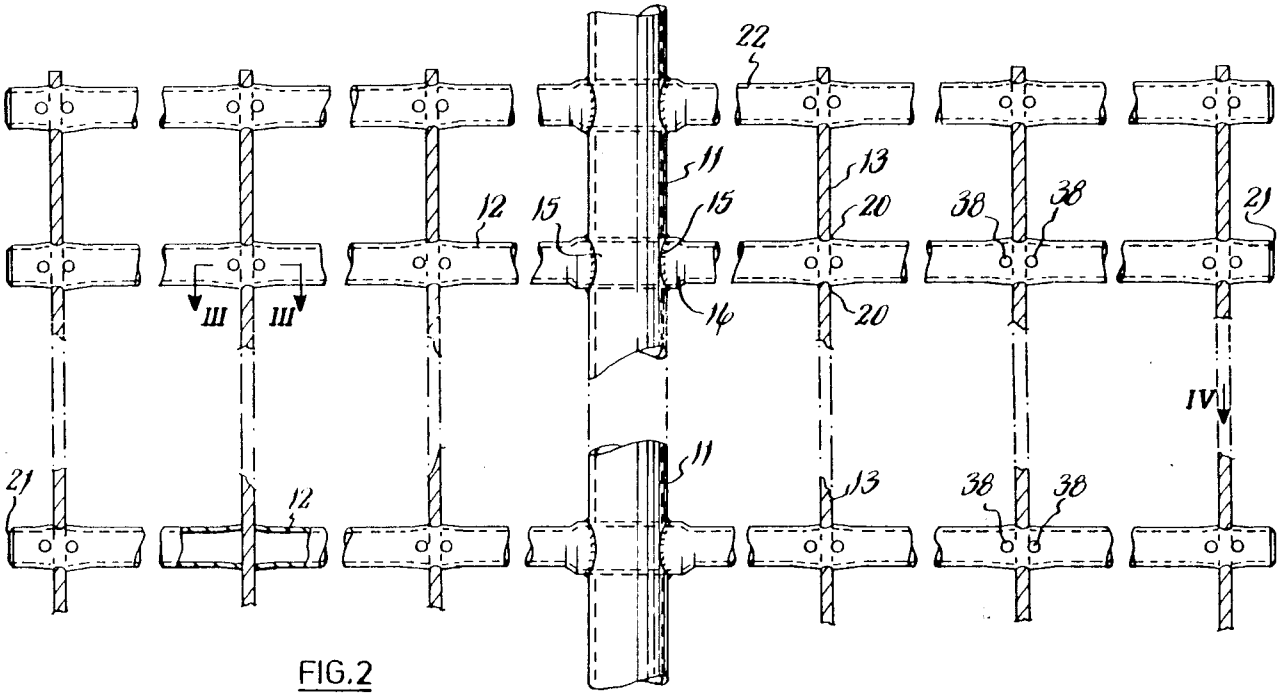
FIG. 2 shows an enlarged view of parts of FIG. 1.

Each section 6,8 comprises an elongated vertical central mast tube 11 of carbon steel with a semi-bright finish to which are fixed a plurality of uniformly vertically spaced, horizontally extending principal cross members 12 of mild steel, which are tubular and in turn support six vertical twisted wires 13 (see also FIG. 2) of mild or stainless steel extending between the cross members 12 and spaced from the tube 11. Each wire 13 is of square cross section (FIGS. 3 and 4) and the twisting provides for example 20 turns per meter of wire. The cross members 12 and the wires 13 are arranged symmetrically on either side of the tube 11 and the spacing between each pair of adjacent wires 13 on either side of the tube 11 is uniform. The wires are uniformly tensioned sufficiently to ensure straightness.

The cross members 12 are located in position in horizontally opposite holes 15 (FIG. 2) which have been formed in the tube 11 from either side.

Each cross member 12 is provided with a central portion 16 deformed to an oval cross section so that as each cross member is pushed into the holes 15 in the tube 11, the deformed portion 16 engages and bites the edges of the holes and is gripped thereby; the central portion 16 is then secured in the holes 15 by welding. It is preferred to form the holes 15 by punching rather than drilling.

End portions of the cross member tubes are chamfered at 21.

Each cross member 12 is provided with vertically opposite holes 20 for the wires 13 and it is preferred to form these holes by drilling. The wires 13 are fixed in position in the holes 20 by crimping the cross member tube to bring the edges of the holes 20 into direct biting engagement with the wires.

Each section 6,8 of the discharge electrode also comprises upper and lower auxiliary structurally re-inforcing horizontal cross members 22,24 respectively and in each section 6,8 the principal cross members 12 are located between the two auxiliary cross members 22,24. The auxiliary cross members 22,24 are generally similar in construction and arrangement to the principal cross members 12, but are relatively closely spaced to the respective adjacent principal cross members 12. It has been found that the structure comprising an auxiliary cross member 22, its adjacent principal cross member 12 and the inter-connecting mast and wire portions provide a surprisingly rigid girder structure which provide the electrode 10 with good structural rigidity in the longitudinal direction and maintaining the tension in the wires 13.

The upper tube 11 comprises an end portion 26 flattened in the plane of the wires 13 for connection to an upper electrode support frame (not shown), and power supply 27. The lower tube 11 similarly comprises a lower end portion 28 also flattened in the plane of the wires 13 for connection to a lower electrode support frame (not shown).

Figure 1:
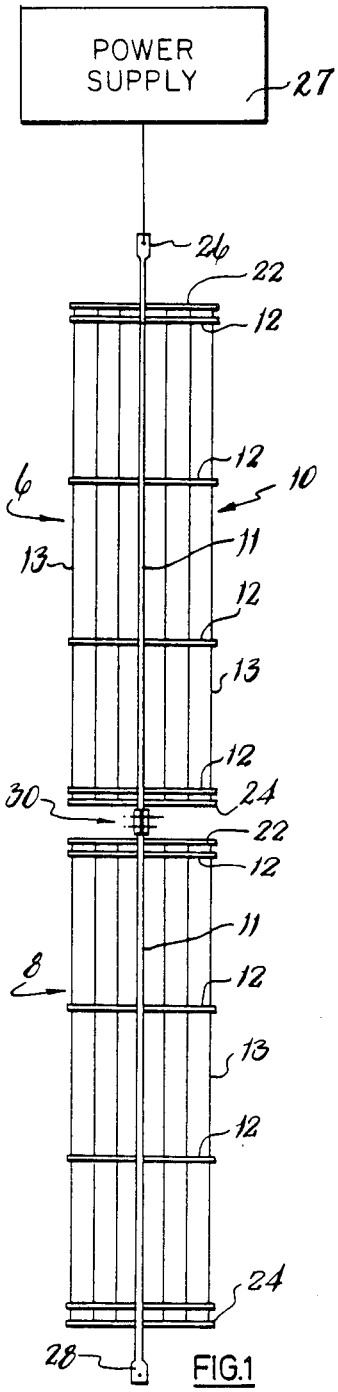
FIG. 1 illustrates the mast discharge electrode embodying the present invention.
Figure 5:
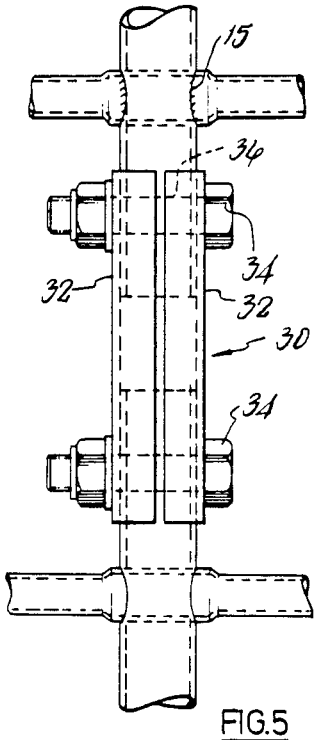
FIG. 5 shows an enlarged view of other parts of FIG. 1.

The two tubes 11 are connected together at the central region of the electrode 10 by a connecting assembly 30 (FIGS. 1 and 5). The connecting assembly 30 comprises two U-shaped opposed channel members 32 between which the tubes 11 are secured by bolts 34 passing through holes 36 punched in the tubes 11 conveniently using the same punching equipment as for the holes 15.

Figure 3:
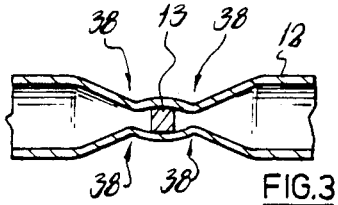
FIG. 3 is a section on the line III—III of FIG. 2.
Figure 4:
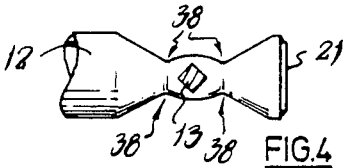
FIG. 4 is a view in the direction of the arrow IV of FIG. 2.

The crimping of each wire 13 to the cross members 12,22,24 is carried out by deforming the cross member tube at four locations 38 (FIGS. 2, 3 and 4) which lie generally in the horizontal plane of the axis of the cross member tube and symmetrically surround (FIGS. 3 and 4) the cross section of the wire. FIG. 4 shows the crimping at a cross member tube end portion and FIG. 3 shows the crimping at an intermediate tube portion. It will be noted that the crimping operation results in circular deformation marks at 38.

EXAMPLE OF DIMENSIONS

The spacing of the axes of auxiliary cross members 22,24 from the axes of their respective adjacent principal cross members 12, is about 65 mm. The spacing between the axes of adjacent principal cross members 12 in each section 6,8 does not exceed about 1525 mm. The spacing between the axes of the auxiliary cross members 22,24 in each section is from 2400 mm to 8600 mm, and the overall height of the discharge electrode 10 between the flattened end portions 26,28 is from 6000 mm to 17,000 mm.

The length of each cross member 12,22 is about 980 mm and the spacing between the axes of adjacent wires 13 on the same side of the tube 11 is about 175 mm; in a modification this spacing may be doubled.

In other modifications any of the mast 11, the cross members 12,22,24 and the wires 13 are of aluminium, stainless steel, brass or other suitable metal or alloy.

It will be realized that shorter discharge electrodes may have only a single tube 11 and longer discharge electrodes have two or more tubes 11, with each pair of adjacent tubes 11 being connected by an assembly 30.

I claim:

1. In an electro-precipitator discharge electrode assembly comprising:

(a) an elongated mast adapted for connection to a power source;

(b) an elongated discharge element electrically connected to said mast and operative when electrically energized to emit an electrical charge onto particle-laden gas in the emission vicinity thereof;

(c) a plurality of principal cross members fixed to the mast, extending transversely of the mast, and having apertures defined extending transversely in the cross members through which to support said discharge element; said principal cross members being separated from each other at predetermined spacings adapted to afford substantially optimum emission efficiency of said discharge element; and (d) said discharge element extending between the principal cross members through the apertures thereof longitudinally of the mast for being secured in the apertures by direct biting engagement of the material of the principal cross members onto the element and in cooperation with said mast and said principal cross members form said assembly in a state of insufficient structural rigidity; the improvement comprising:

an auxiliary re-inforcing cross member also fixed to the mast extending transversely of the mast generally parallel to said principal cross members and having a transverse aperture for securing an end portion of said discharge element; said auxiliary cross member being spaced from the nearest principal cross member relatively closer than said predetermined spacing between said principal cross members for cooperating with said principal cross members, said mast, and said discharge element to effect a substantially rigid girder structure of said assembly.

2. A discharge electrode according to claim 1, wherein the discharge element is secured in the aperture of the auxiliary cross member by direct biting engagement of the material of the cross member onto the element.

3. A discharge electrode according to claim 1, wherein the spacing of the axis of the auxiliary cross member from the axis of its adjacent principal cross member is from 40 mm to 65 mm.

4. A discharge electrode according to claim 1, wherein the cross members are tubular.

5. A discharge electrode according to claim 1, comprising another auxiliary re-inforcing cross member also fixed to the mast, extending transversely to the mast, having the discharge element secured thereto, and being relatively closely spaced to an adjacent principal cross member; said plurality of principal cross members being located between the two auxiliary cross members.

6. A discharge electrode according to claim 5, wherein each auxiliary cross member has an aperture defined extending transversely therein, and the discharge element is secured in the aperture by direct biting engagement of the material of the cross member onto the element.

7. A discharge electrode according to claim 5, wherein the spacing of the axis of each auxiliary cross member from the axis of its adjacent principal cross member is from 40 mm to 65 mm.

8. A discharge electrode according to claim 5, wherein the spacing between the axes of the two auxiliary cross members is from 2,000 mm to 9,000 mm.

9. A discharge electrode according to claim 5, wherein the cross members extend at right angles to the mast symmetrically on either side of the mast and a plurality of elongated discharge elements extend between the cross members parallel to the mast.

10. A discharge electrode according to claim 9, wherein there are at least three elongated discharge elements on one side of the mast and at least three on the other side.

11. A discharge electrode according to claim 9, wherein each cross member is more than 600 mm in length.

12. A discharge electrode according to claim 9, wherein each cross member is more than 750 mm in length.

13. A discharge electrode according to claim 9, wherein each cross member is more than 900 mm in length.

14. A discharge electrode according to claim 9, wherein the principal cross members are uniformly spaced and the spacing between the axes of adjacent principal cross members does not exceed 1,600 mm.

15. A discharge electrode according to claim 9, wherein there are at least two elongated discharge elements on one side of the mast and at least two on the other side.

16. A discharge electrode according to claim 15, wherein the spacing between the axes of adjacent discharge elements on the same side of the mast is from 150 mm to 400 mm.

17. A discharge electrode according to claim 1, wherein the discharge element is a twisted wire.

18. A discharge electrode according to claim 17, wherein the wire is of a square cross section and the twisting provides from 10 to 20 turns per meter of wire.

* * * * *